US010569326B2

(12) United States Patent
Arvedi et al.

(10) Patent No.: US 10,569,326 B2
(45) Date of Patent: Feb. 25, 2020

(54) THIN SLAB NOZZLE FOR DISTRIBUTING HIGH MASS FLOW RATES

(71) Applicants: ARVEDI STEEL ENGINEERING S.P.A., Cremona (IT); VESUVIUS CRUCIBLE COMPANY, Wilmington, DE (US)

(72) Inventors: Giovanni Arvedi, Cremona (IT); Andrea Teodoro Bianchi, Piadena (IT); Johan Richaud, Cheval Blanc (FR)

(73) Assignees: ARVEDI STEEL ENGINEERING S.P.A., Cremona (IT); VESUVIUS U.S.A. CORPORATION, Champaign, IL (US)

( * ) Notice: Subject to any disclaimer, the term of this patent is extended or adjusted under 35 U.S.C. 154(b) by 455 days.

(21) Appl. No.: 15/317,701

(22) PCT Filed: Jun. 3, 2015

(86) PCT No.: PCT/IB2015/054197
§ 371 (c)(1),
(2) Date: Dec. 9, 2016

(87) PCT Pub. No.: WO2015/189742
PCT Pub. Date: Dec. 17, 2015

(65) Prior Publication Data

US 2017/0129002 A1 May 11, 2017

(30) Foreign Application Priority Data

Jun. 11, 2014 (EP) ..... 14171989

(51) Int. Cl.
*B22D 11/04* (2006.01)
*B22D 11/041* (2006.01)
(Continued)

(52) U.S. Cl.
CPC ..... *B22D 11/0408* (2013.01); *B22D 11/041* (2013.01); *B22D 11/10* (2013.01); *B22D 41/50* (2013.01)

(58) Field of Classification Search
CPC ... B22D 11/0408; B22D 11/041; B22D 11/10; B22D 41/50
(Continued)

(56) References Cited

U.S. PATENT DOCUMENTS 6,152,336 A * 11/2000 Arvedi ..... B22D 41/50 222/594
7,757,747 B2 7/2010 McIntosh
2003/0150588 A1 * 8/2003 Urlau ..... B22D 41/50 164/459

FOREIGN PATENT DOCUMENTS

AT 258088 T 2/2004
CN 1222104 A 7/1999
(Continued)

OTHER PUBLICATIONS

JP20170517439 Written Opinion Translation dated Aug. 15, 2019.
JP20170517439 Written Amendment Translation dated Aug. 15, 2019.

*Primary Examiner* — Jessee R Roe
*Assistant Examiner* — Michael Aboagye
(74) *Attorney, Agent, or Firm* — Thomas Clinton; Donald M. Satina

(57) ABSTRACT

A thin slab nozzle contains a central bore extending downstream along longitudinal axis X1 from an inlet orifice at an upstream end. The central bore comprises an upstream bore portion with a height Ha, in communication with a converging bore portion of height He, in communication with a thin bore portion of height Hf ending at the upstream end of a divider, and first and second front ports separated from one another by the divider and coupled to the central bore
(Continued)

portion at least partially at the converging bore portion. X2 is a transverse axis, normal to X1, along which the nozzle becomes thinner in a downstream portion. In a section of the thin slab nozzle along a symmetry plane Π1 defined by X1 and by X2, the bore wall of the converging bore portion is curved at all points, and Hf/He≤1.

14 Claims, 7 Drawing Sheets

(51) Int. Cl.
*B22D 41/50* (2006.01)
*B22D 11/10* (2006.01)

(58) Field of Classification Search
USPC ..... 222/606, 591, 590, 594, 607; 164/488, 164/337, 437
See application file for complete search history.

(56) References Cited

FOREIGN PATENT DOCUMENTS

| | | | |
|---|---|---|---|
| CN | 1842386 | A | 10/2006 |
| CN | 201313176 | Y | 9/2009 |
| CN | 101733373 | A | 6/2010 |
| CN | 201565599 | U | 9/2010 |
| CN | 203330395 | U | 12/2013 |
| CN | 104057077 | A | 9/2014 |
| CN | 203944833 | U | 11/2014 |
| DE | 4319195 | A1 | 12/1994 |
| DE | 10117097 | A1 | 10/2002 |
| EP | 0482423 | A1 | 4/1992 |
| EP | 0925132 | A1 | 6/1999 |
| EP | 1002600 | A2 | 5/2000 |
| EP | 1657009 | A1 | 5/2006 |
| EP | 1854571 | A1 | 11/2007 |
| JP | 2000512909 | A | 10/2000 |
| UA | 41999 | U | 6/2009 |
| WO | 9200815 | A1 | 1/1992 |
| WO | 9529025 | A1 | 11/1995 |
| WO | 9748512 | A1 | 12/1997 |
| WO | 9814292 | A1 | 4/1998 |
| WO | 0050189 | A1 | 8/2000 |
| WO | 0059650 | A1 | 10/2000 |
| WO | 02081128 | A1 | 10/2002 |
| WO | 2004026497 | A1 | 4/2004 |
| WO | 20005021187 | A1 | 3/2005 |
| WO | 2006106376 | A1 | 10/2006 |

* cited by examiner

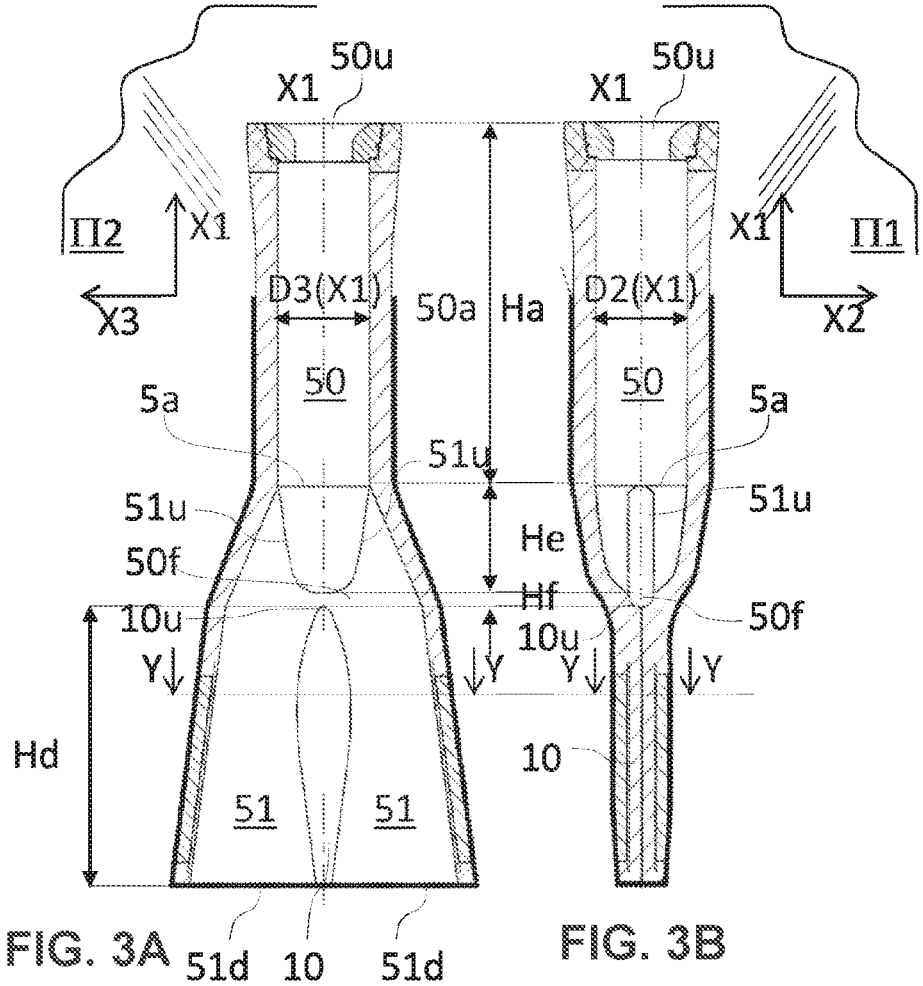
FIG. 3A
FIG. 3B
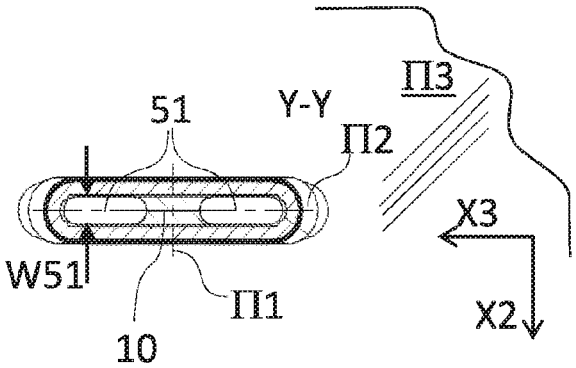
FIG. 3C

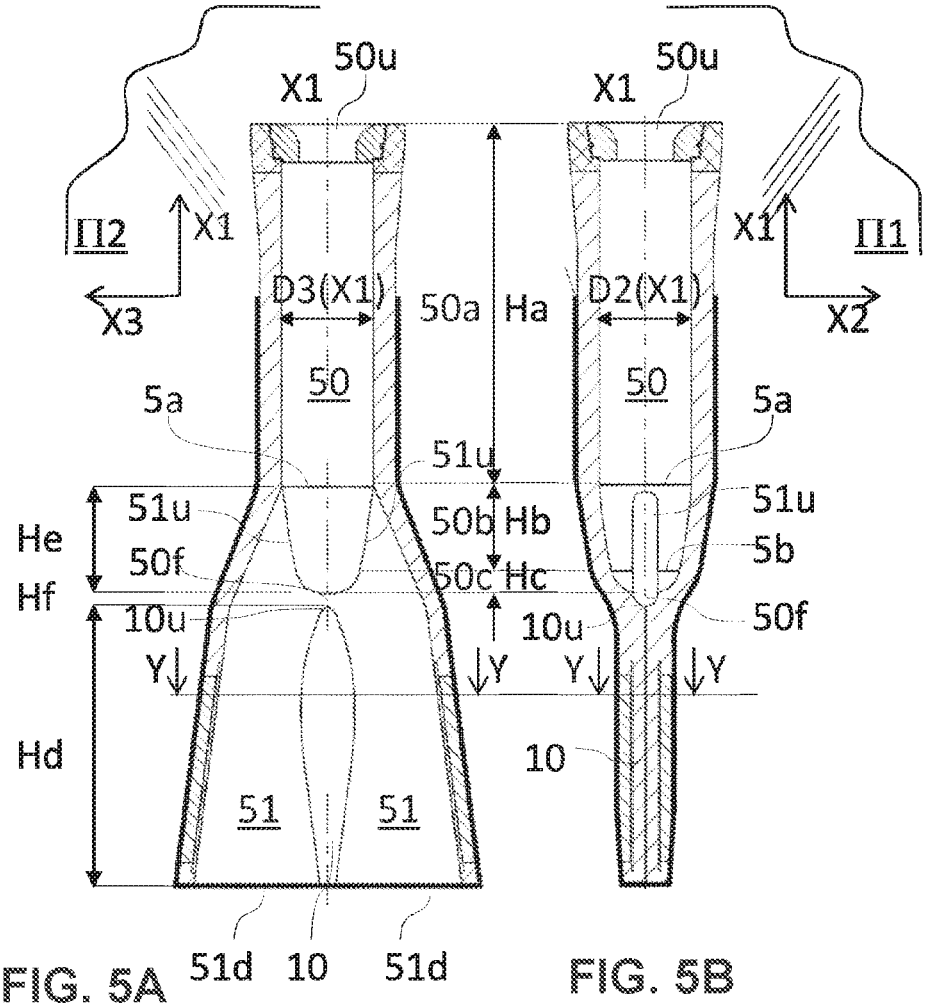
FIG. 5A
FIG. 5B
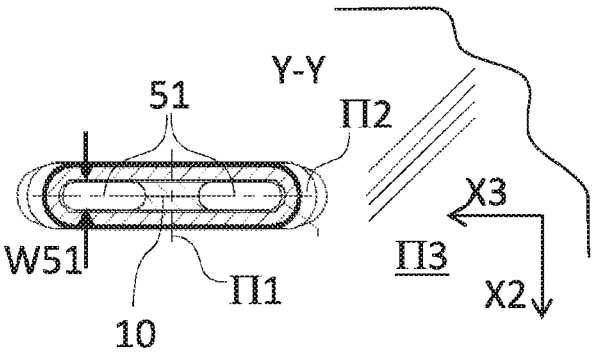
FIG. 5C

THIN SLAB NOZZLE FOR DISTRIBUTING HIGH MASS FLOW RATES

BACKGROUND OF THE INVENTION

(1) Field of the Invention

The present invention relates to submerged entry nozzles for the continuous casting of metal or metal alloy thin slabs, hereinafter referred to as "thin slab nozzles". In particular, it concerns thin slab nozzles with a particular geometry allowing a better control of very high flow rates of molten metal into a thin slab mould. The present invention also concerns a metal casting installation, with or without subsequent rolling, comprising such a thin slab nozzle.

(2) Description of the Related Art

In continuous metal forming processes, metal melt is transferred from one metallurgical vessel to another, to a mould or to a tool. For example, as shown in FIG. 1 a ladle (11) is filled with metal melt out of a furnace and transferred to a tundish (10) through a ladle shroud nozzle (111). The metal melt can then be cast through a pouring nozzle (1) from the tundish to a mould for forming slabs, billets, beams, thin slabs, or ingots. Flow of metal melt out of the tundish is driven by gravity through the pouring nozzle (1) and the flow rate is controlled by a stopper (7). A stopper (7) is a rod movably mounted above and extending coaxially (i.e. vertically) to the pouring nozzle inlet orifice. The end of the stopper adjacent to the nozzle inlet orifice is the stopper head and has a geometry matching the geometry of said inlet orifice such that when the two are in contact with one another, the nozzle inlet orifice is sealed. The flow rate of molten metal out of the tundish and into the mould is controlled by continuously moving up and down the stopper such as to control the space between the stopper head and the nozzle orifice.

Control of the flow rate Q of the molten metal through the nozzle is very important because any variation thereof provokes corresponding variations of the level of the meniscus (200*m*) of molten metal formed in the mould (100). A stationary meniscus level must be obtained for the following reasons. A liquid lubricating slag is artificially produced through the melting of a special powder on the meniscus of the building slab, which is being distributed along the mould walls as flow proceeds. If the meniscus level varies excessively, the lubricating slag tends to collect in the most depressed parts of the wavy meniscus, thus leaving exposed its peaks, with a resulting null or poor distribution of lubricant, which is detrimental to the wear of the mould and to the surface of the metal part thus produced. Furthermore, a meniscus level varying too much also increases the risks of having lubricating slag being entrapped within the metal part being cast, which is of course detrimental to the quality of the product. Finally, any variation of the level of the meniscus increases the wear rate of the refractory outer walls of the nozzle, thus reducing the service time thereof.

A particular field of metallurgy is the production of thin metal strips. Traditionally, the final gauge of a strip is obtained by cold rolling, which is an expensive process since semi-finished products produced from a caster need to be cooled, stored, often transported to a new plant and reheated to hot-roll thicker strips to be finally cold rolled and annealed. Various methods have been proposed to link a continuous caster to a hot rolling station such as to produce thin gauge strips of the order of less than 1.5 mm in a continuous or semi-continuous process from the casting stage to the hot rolling stage, thus reducing energy and water consumptions by far more than half. Such processes are described for example in WO 92/00815, WO 00/50189, WO 00/59650, WO 2004/026497, and WO 2006/106376. In particular WO 2004/026497 discloses a so called "endless" process, where the metallic matter is always connected without any interruption from the casting stage to the rolling stage, with the strip being cut to length when it is already at the final thickness and in front of the coilers. In those lines unprecedented productivities for a single casting line up to 4 million tonnes per year can be reached. The continuous casting stage in such processes must allow the production of thin slabs without intermediate treatments of the slab coming out of a thin slab mould. Thin slabs are semi-finished products having a width substantially larger than their thickness which is typically of the order of 30 to 120 mm. For such applications, in order to guarantee the subsequent rolling operations and temperature further than the productivity, it is fundamental to cast e.g. thin steel slabs at a high flow rate, up to 5 Kg/min per mm of width, that means e.g. with a 2.1 m wide steel slab to be able to cast up to 10 tonnes/min. Very specific nozzles must be used, often called and herein referred to as "thin slab nozzles". As illustrated in FIGS. 1 and 2, a thin slab nozzle (1) comprises an upstream portion of tube extending along a longitudinal axis X1, generally but not necessarily cylindrical with circular section, joined in a known manner to an upper vessel such as a tundish (10). It is usually used in combination with a stopper (7) for controlling the flow rate of molten metal (200) through the thin slab nozzle. At a downstream portion, opposite said upstream portion, a thin slab nozzle becomes thinner along a first transverse axis X2 normal to the longitudinal axis X1 and broader along a second transverse axis X3 normal to both longitudinal and first transverse axes X1 and X2 such that it can fit in the mould cavity, while maintaining a necessary clearance from the mould walls. The downstream portion is often referred to as "diffuser" or "outlet diffusing portion", and is provided with two front ports (51) opening at port outlets (51*d*). The diffuser allows feeding molten metal (200) to the thin slab mould (100) as the slab is being formed; and begins solidifying in a shell (200*s*) as it contacts the cold walls of the mould.

The upstream portion and downstream portion of a thin slab nozzle are connected to one another by a connecting portion, giving thin slab nozzles their typical overall shovel-like shape. As illustrated in FIG. 2, the bore of a thin slab nozzle comprises a central bore (50) comprising the inlet orifice and ending at the level of a divider (10), best visible in FIG. 3(*a*), defining two ports (51) including the outlet port orifices of the thin slab nozzle. The central bore (50) comprises an upstream bore portion (50*a*) and a converging bore portion (50*e*). The role of the converging bore portion (50*e*) is very critical as the geometry of the central bore (50*a*), essentially axis-symmetrical with respect to the longitudinal axis X1, changes radically at the level of the ports (51) extending in the flat and broad outlet diffusing portion with a planar symmetry with respect to a plane Π2 defined by the longitudinal axis X1, and the second transverse axis X3, thus considerably disturbing the flow pattern of molten metal passing from the upstream to the downstream portions of the nozzle. The converging bore portion (50*e*) of a thin slab nozzle must therefore ensure that the molten metal flows as smoothly as possible from the upstream portion of a thin slab nozzle to the outlet diffusing portion located at a downstream end of the thin slab nozzle. The metal melt must enter into the front ports (51) in a state as appropriate as possible, with low turbulence levels (meaning small scale eddies or no large turbulence), minimal velocity and pressure variations, thus without flow detachment along the port walls and consequently with a velocity as uniform as possible along the ports (51*d*). The term "thin slab nozzle" is used herein to refer exclusively to such nozzles as described above and suitable for transferring molten metal from a metallurgical vessel such as a tundish to a thin slab mould. This explicitly excludes from the definition of "thin slab nozzle" any nozzle having a substantially axis-symmetrical geometry of the outer walls of the downstream portion thereof.

The control of the level of the meniscus (200*m*) formed by molten metal and slag in a thin slab mould is achieved mainly by modifying the distance between the stopper head of a stopper (7) and the inlet orifice of the thin slab nozzle (1) as discussed above with respect to nozzles in general (see FIG. 2). As discussed above, this control is very important for ensuring a good quality of a cast metal part. It is, however, particularly delicate and difficult for the casting of thin slabs, because of the very thin breadth or thickness L of thin slab moulds. Indeed, because of the reduced cross-sectional area L×W of such moulds normal to the longitudinal axis X1 (area=breadth or thickness L×width W), any variation in the flow rate Q of molten metal provokes a substantial variation in the level of the meniscus with amplitudes of variations which are considerably higher than with other types of moulds such as for thicker beams, profiles, etc. having larger cross-sections.

EP 925132 proposes a thin slab nozzle improving the control of the flow of molten metal from a metal vessel such as a tundish to a thin slab mould, and having a particular geometry of the thin slab nozzle cavity at the level of the diffuser. For example, the combined cross-sectional area of the two front ports at the level of the end of the converging bore portion (50*e*) is lower than the corresponding cross-sectional area at the boundary between the upstream and converging bore portions (50*a*, 50*e*) of the nozzle. Although the side walls of the ports diverge downwards in a plane Π2 defined by the longitudinal axis X1 and second transverse axis X3, they are convergent in planes Π1 and Π3, respectively defined by axes (X1, X2) and (X2, X3), thus giving rise to a reduction of cross-section in the downward direction. The cavity walls in the connecting portion of the thin slab nozzle represented in FIG. 2 of EP 925132 are clearly converging linearly.

EP 1854571 discloses a thin slab nozzle, focusing on the geometry of an ogival divider, having continuous contours and an angle at the vertex comprised between 30° and 60°. The divider in its lower portion is symmetrically tapered with its sides towards the median vertical axis. This design solves drawbacks appearing in thin slab nozzles of the type disclosed in EP 925132 discussed above. In particular, it prevents instability and detachment of the flow from occurring along the contours of the flow divider. Flow detachments are causing vortices as metal flows along the contours of the flow divider provoking vein partition (flow separation) phenomena. These vortices have the tendency to be dragged by the stream into the mould and combine with the turbulent flow structures caused by an excessive fluid friction (turbulent interaction) between the opposed narrow surfaces of both obtained exiting flows lead to instability, asymmetry, and oscillation of the mould flow pattern, as well as excessively rapid circulation of flows towards the meniscus (bath surface) without the proper penetration of the liquid mass.

Each of U.S. Pat. No. 7,757,747, WO 9529025, WO 9814292, WO 02081128 and DE 4319195 discloses thin slab nozzles having a divider of height substantially smaller than the dividers of the thin slab nozzles described above, yielding a very short pair of ports. It is believed that allowing molten metal to flow out of the outlet port orifices so soon after the flow was split into two distinct streams does not allow the formation of close to parallel streamlines not disturbed by large scale eddies, alike laminar flow into a thin slab mould. With such geometry a clear distinction in the central bore between an upstream bore portion (50*a*) and a converging bore portion (50*e*) is not possible anymore.

U.S. Pat. No. 7,757,747 discloses a thin slab nozzle comprising a first central divider splitting the flow path defined by a central bore portion into two sub-flows, and further comprising two short dividers splitting each sub-flow into two further sub-flows, yielding a nozzle comprising four port outlets. Along a first direction, the central bore decreases continuously from the inlet orifice to the first divider (see FIG. 2 of U.S. Pat. No. 7,757,747) and can therefore not be divided into an upstream bore portion (50*a*) and a converging bore portion (50*e*) since the whole central bore continuously converges. Similarly, WO 9814292 and WO 9529025 show a central bore cross-section getting continuously thinner along a first direction and broader along a second direction normal to the first direction until it reaches a divider (see FIG. 15 of WO 9814292). In all cases, the front ports are extremely short.

In WO 02081128 the upstream portion of the central bore continuously evolves from a circular to an elliptical cross-section, and if a converging bore portion (50*e*) can be identified as referral number 3, it does not end the central bore but simply gets thinner along a first direction and broader along a second direction normal to the first direction, until it finally reaches a divider to split the flow along two extremely short ports. DE 4319195 discloses a thin slab nozzle comprising a clear converging bore portion converging linearly on a first plane of symmetry of the nozzle, and diverging linearly on a second plane of symmetry, normal to the first plane of symmetry. Again the converging bore portion does not end the central bore, which continues as a thin and broad channel until it meets a divider forming two ports.

The various solutions proposed in the art for thin slab nozzles do not quite satisfactorily fulfill yet all the stringent flow requirements for a thin slab nozzle and for continuously linking the casting stage to a hot-rolling stage in a process as discussed above.

The main requirements may be listed as follow:

a) the possibility to deliver molten metal at very high mass-flow rates into the mould;

b) a proper distribution of velocity of the flow on the outlet ports;

c) recirculation flows in the mould with a steady and controlled flow pattern (the same type of recirculation flow)

d) the need for an excellent stability of the liquid metal and molten mould powder interface referred to as "meniscus".

The present invention proposes a thin slab nozzle which offers an excellent control of the flow of molten metal into a thin slab mould, wherein the thin slab can be driven directly to a hot rolling stage for producing a thin strip of desired gauge (e.g. <10 mm). This and other advantages are discussed in the following sections.

BRIEF SUMMARY OF THE INVENTION

The present invention is defined in the appended independent claims. Particular embodiments are defined in the dependent claims. In particular, the present invention concerns a thin slab nozzle for casting thin slabs made of metal, said thin slab nozzle having a geometry symmetrical with respect to a first symmetry plane Π1 defined by a longitudinal axis X1 and a first transverse axis X2 normal to X1, and symmetrical with respect to a second symmetry plane Π2, defined by the longitudinal axis X1 and a second transverse axis X3 normal to both X1 and X2, said thin slab nozzle extending along said longitudinal axis X1 from:

an inlet portion, located at an upstream end of the thin slab nozzle and comprising an inlet orifice oriented parallel to said longitudinal axis X1 to an outlet diffusing portion located at a downstream end of the thin slab nozzle and comprising a first and second outlet port orifices, said outlet diffusing portion having a width measured along the second transverse axis X3 which is at least three (3) times larger than the thickness thereof measured along the first transverse axis X2 and a connecting portion connecting the inlet portion and outlet diffusing portion, said thin slab nozzle further comprising:

a central bore defined by a bore wall and opening at said inlet orifice and extending therefrom along the longitudinal axis X1 until it is closed at an upstream end of a divider, said central bore comprising:

an upstream bore portion comprising the inlet orifice and extending over a height Ha and, adjacent thereto, forming an upstream boundary with a converging bore portion of height He located in the connecting portion of the thin slab nozzle, and adjacent thereto a thin bore portion of height Hf located in the diffusing portion of the thin slab nozzle and ending at the level of the upstream end of the divider, a first and second front ports separated from one another by said divider and extending parallel to said second symmetry plane Π2, said first and second front ports extending from a first and second port inlets opening at least partially on two opposite walls of the converging bore portion, to said first and second outlet port orifices, said first and second front ports having a width W51, measured along the first transverse axis X2, which is always smaller than the width D2(X1) of the upstream bore portion measured along the first transverse axis X2, characterized in that, in a section of the thin slab nozzle along the first symmetry plane Π1, the geometry of the wall of the central bore is characterized as follows:

the radius of curvature pal at any point of the bore wall over at least 90% of the height Ha of the upstream bore portion tends towards infinite, the radius of curvature at any point of the bore wall of the converging bore portion is finite, and the ratio of the height Hf of the thin bore portion to the height He of the converging portion is not more than 1, Hf/He≤1.

In particular embodiments, the radius of curvature at any point of the bore wall of the converging bore portion is not constant throughout the height He of the converging bore portion (thus excluding a hemispherical converging bore portion).

In the present context, the terms "upstream" and "downstream" are defined with respect to the direction of flow of molten metal when a thin slab nozzle is operational and coupled to the bottom floor of a tundish or any other metallurgic vessel (in FIGS. 1 to 6 said direction is vertical from top (upstream) to bottom (downstream)).

In order to maintain the streamlines as parallel as possible and prevent flow detachment, it is efficacious that the total bore cross-sectional area remains relatively constant from the inlet portion down to an upstream portion of the connecting portion including both central bore and front ports. In particular, the total cross-sectional area A (X1) measured on planes Π3 normal to the longitudinal axis X1, of both central bore and first and second front ports is characterized in that the relative variation, ΔA(X1)/Aa=|Aa−A(X1)|/Aa, of the total cross-sectional area A(X1) with respect to the total cross-sectional area Aa at the upstream boundary is not greater than 15%, for any plane Π3 intersecting the longitudinal axis X1, from the upstream boundary down to 70% of the height He of the converging bore portion. In another embodiment, it is efficacious that the total cross-section of the central bore and front ports never increases throughout the height of the central bore such that the derivative dA/dX1 in the converging bore portion of the total cross-sectional area A on any plane Π3 normal to the longitudinal axis X1, with respect to the position of said plane Π3 on the longitudinal axis X1, is never greater than 0, dA/dX1≤0.

In a particular embodiment, the converging bore portion is further divided into two bore portions:

an end bore portion of height Hc and a transition bore portion of height Hb comprised between and adjacent to the upstream bore portion and the end bore portion, thus forming at one end a transition boundary with the end bore portion and, at the other end the upstream boundary with the upstream bore portion, and wherein in a section of the thin slab nozzle along the first symmetry plane Π1 the geometry of the wall of the converging bore portion is characterized as follows:

the radius of curvature ρc1 at any point of the bore wall of the end bore portion is not greater than ½ D2*a*, wherein D2*a* is the width of the central bore at the upstream boundary, ρc1≤½ D2*a;* the radius of curvature ρb1 at any point of the bore wall of the transition bore portion is greater than ½ D2*a* and is equal to or greater than 5×ρc1 and equal to or less than 50×D2*a*; and the height ratio Hb/Hc of the transition bore portion to the end bore portion (50*c*) is equal to or greater than 3 and equal to or less than 12.

In particular, it is efficacious that the sections along plane Π1 of at least one of the end bore portion and transition bore portion form an arc of a circle. In other words, the radius of curvature ρb1 measured on a section of the thin slab nozzle along plane Π1 is constant at any point of the bore wall of the transition bore portion and/or the radius of curvature ρc1 measured on a section of the thin slab nozzle along plane Π1 is constant at any point of the bore wall of the end bore portion.

In a particular embodiment, the geometry of a section of the central bore of the thin slab nozzle along symmetry plane Π, defined above applies also to a section along symmetry plane Π2 and, efficaciously, applies also to any section along a plane Πi comprising the longitudinal axis X1. In particular, excluding the first and second port inlets, the radii of curvature and height ratios of the bore wall of the converging bore portion, transition bore portion and end bore portion defined above with respect to a section of the thin slab nozzle along the first symmetry plane Π1 apply also to a section of the thin slab nozzle along the symmetry plane Π2 and efficaciously, along any plane Πi comprising the first longitudinal axis X1. In a more defined embodiment, the converging bore portion has an elliptical or even circular cross-section along any plane Π3 normal to the longitudinal axis X1. In case of a circular cross-section, the central bore portion (excluding the port inlets) has geometry of revolution. In other words, the central bore, excluding the first and second port inlets, may have an elliptical or circular cross section along a plane Π3 normal to the longitudinal axis X1, having principal diameters D2(X1), D3(X1) along the first transverse axis X2 and second transverse axis X3 respectively, whose dimensions evolve along the longitudinal axis X1 such that the ratio D2(X1)/D3(X1) remains constant, with D2(X1)≤D3(X1). This means that a circle remains a circle, and an ellipse remains an ellipse of same proportions along the longitudinal axis X1 (homothety).

It is efficacious that the side port inlets be located mostly in the converging bore portion. The upstream ends of the side port inlets are efficaciously located close to the upstream boundary. Similarly it is efficacious that the downstream ends of the side port inlets be close to the downstream end of the converging bore portion. The distance between downstream ends of the side port inlets and the downstream end of the converging bore portion is defined by the height Hf of the thin bore portion which should therefore be relatively small. In particular, the distance between the upstream end of the thin slab nozzle and the upstream end of the first and second port inlets is comprised within Ha (1±7%) and/or within Ha (1±0.07) and/or within (Ha±30 mm). Concerning the height Hf it is efficacious that the ratio of the height Hf of the thin bore portion to the height He of the converging portion is not more than 50%, or not more than 25%, or not more than 15%. Taking an alternative reference, it is efficacious that the ratio of the height Hf of the thin bore portion to the height of the central bore (=Ha+He+Hf) is less than 15%, or not more than 10%, or not more than 7%, or not more than 3%.

As discussed above, the front ports efficaciously meet the central bore portion at the level of the converging bore portion (it may extend a bit upstream and downstream of the converging bore portion). On plane Π2 defined by axis (X1, X3) the first and second front ports efficaciously meet the central bore at an angle α with respect to the longitudinal axis X1, equal to or greater than 5° and equal to or less than 45°, or equal to or greater than 15° and equal to or less than 40°, or equal to or greater than 20° and equal to or less than 30°. The ratio W51/D2*a*, of the width W51 of the first and second front ports along the first transverse axis X2 to the width D2*a* along the first transverse axis X2 of the central bore at the upstream boundary is equal to or greater than 15% and equal to or less than 40%, or equal to or greater than 24% and equal to or less than 32%.

The geometry of the divider separating one front port from the other is of importance. In a section along the second symmetry plane Π2, the divider (10) in contact with the first and second ports (51) is characterized by both its walls extending from the upstream end (10*u*) of the divider to the downstream end of the thin slab nozzle along the longitudinal axis X1, first diverging until the divider (10) reaches its maximum width and then converging until they reach the downstream end of the thin slab nozzle. The height Hd of the divider (10) is efficaciously at least twice as large as the height He of the converging bore portion, Hd≥2 He. This ensures that the front ports are long enough to allow the streamlining of the flow of molten metal after diverting it from the central bore to the front ports.

In a particular embodiment, the ratio D2*b*/D2*a*, of the width D2*b* along the first transverse axis X2 of the central bore at the transition boundary to the width D2*a* along the first transverse axis X2 of the central bore at the upstream boundary is equal to or greater than 65% and equal to or less than 85%, or equal to or greater than 70% and equal to or less than 80%.

The present invention also concerns a metal casting installation for casting thin slabs comprising a metallurgical vessel, such as a tundish, provided with at least an outlet in fluid communication with a thin slab nozzle as defined above, whose outlet diffusing portion is inserted in a thin slab mould. In particular, the metal casting installation is of the type described in any of WO 92/00815, WO00/50189, WO 00/59650, WO 2004/026497, and WO 2006/106376.

BRIEF DESCRIPTION OF THE SEVERAL VIEWS OF THE DRAWINGS

For a fuller understanding of the nature of the present invention, reference is made to the following detailed description taken in conjunction with the accompanying drawings in which:

FIG. 3: shows section views over three perpendicular planes, Π1, Π2, Π3, of a thin slab nozzle according to a first embodiment of the present invention.

FIG. 5: shows section views over three perpendicular planes, Π1, Π2, Π3, of a thin slab nozzle according to a second embodiment of the present invention.

DETAILED DESCRIPTION OF THE INVENTION

Figure 1:
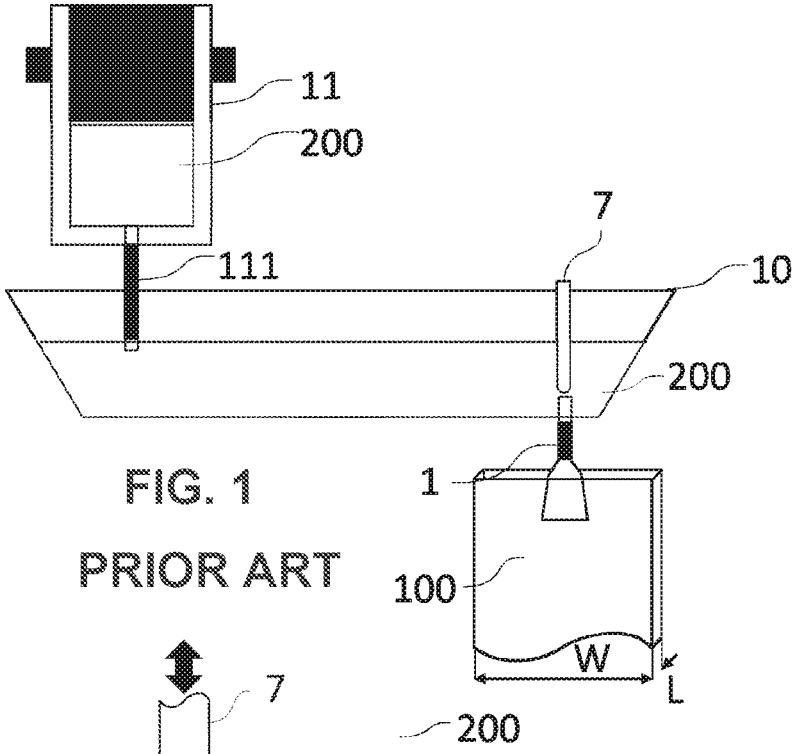
FIG. 1 PRIOR ART
FIG. 1: represents a general view of a casting installation for casting thin slabs.
Figure 2:
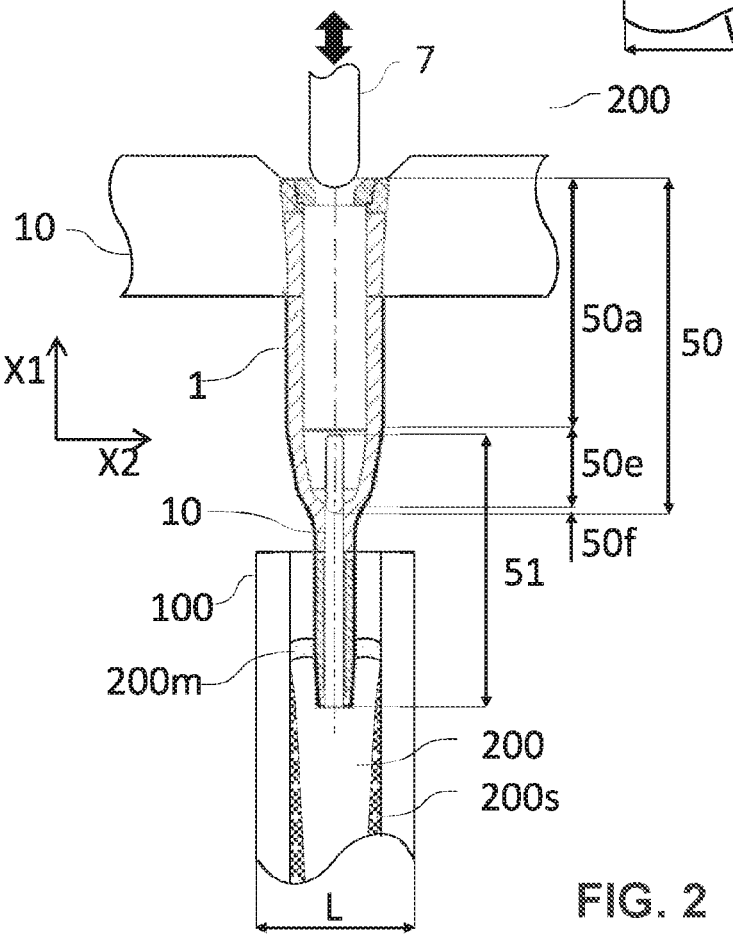
FIG. 2: shows a sectional side view of the bottom of a tundish with a ladle shroud nozzle according to the present invention.

As illustrated in FIG. 1, a thin slab nozzle (1) according to the present invention is suitable for being coupled to the bottom floor of a tundish (10) for transferring molten metal (200) from said tundish to a thin slab mould (100). As shown in FIG. 2, a thin slab mould is characterized by a small dimension L in a first transverse direction X2. Consequently, the portion of a thin slab nozzle which is inserted in the thin slab mould must also be quite thin in said first transverse direction X2. The flow rate of molten metal through the thin slab nozzle is generally controlled by a stopper (7) whose function is discussed in the introductory portion of the present specification.

A thin slab nozzle according to the present invention comprises three main portions illustrated in FIGS. 3 and 5:

- an inlet portion, located at an upstream end of the thin slab nozzle and comprising an inlet orifice (50*u*) oriented perpendicular to the longitudinal axis X1; the inlet portion is suitable for being coupled to the bottom floor of a tundish;

an outlet diffusing portion located at a downstream end of the thin slab nozzle and comprising a first and second outlet port orifices (51*d*), said outlet diffusing portion having a width measured along the second transverse axis X3 which is at least three (3) times larger than the thickness thereof measured along the first transverse axis X2; the diffusing portion is suitable for being inserted in a thin slab mould; and a connecting portion forming the transition between the inlet portion and the outlet diffusing portion.

The thin slab nozzle comprises a bore system fluidly connecting the inlet orifice (50*u*) to the outlet port orifices (51*d*). As illustrated in FIGS. 2, 3 and 5, the bore system comprises:

a central bore (50) defined by a bore wall and opening at said inlet orifice (50*u*) and extending therefrom along the longitudinal axis X1 until it is closed at an upstream end (10*u*) of a divider (10), said central bore comprising:

an upstream bore portion (50*a*) comprising the inlet orifice and extending over a height Ha and, adjacent thereto, forming an upstream boundary (5*a*) with, a converging bore portion (50*e*) of height He located in the connecting portion of the thin slab nozzle, and adjacent thereto a thin bore portion (50*f*) of height Hf located in the diffusing portion of the thin slab nozzle and ending at the level of the upstream end (10*u*) of the divider (10), first and second front ports (51) separated from one another by said divider (10) and extending parallel to the second symmetry plane Π2, said first and second front ports extending from first and second port inlets (51*u*), opening at least partially on two opposite walls of the converging bore portion (50*e*), to said first and second outlet port orifices (51*d*), said first and second front ports (51) having a width W51, measured along the first transverse axis X2, which is always smaller than the width D2(X1) of the upstream bore portion (50*a*) measured along the first transverse axis X2.

The geometries of the upstream portion and outlet diffusing portion are so different, the former being substantially cylindrical and the latter being thin, flat and flaring out, that the geometries of the bore system in said portions must also differ substantially. The upstream bore portion is generally substantially prismatic, elliptic, often but not necessarily cylindrical, or homothetic with side walls slowly converging downstream with a moderate angle of not more than 5°. In all cases, apart from the upstream orifice (50*u*) whose geometry must match the shape of the stopper head (7), the walls of the upstream bore portion (50*a*) are substantially straight, i.e. the radius of curvature pal at any point of the bore wall over at least 90% of the height Ha (excluding the region of the inlet orifice) of the upstream bore portion (50*a*) tends towards infinite. On the other hand, the front ports (51) are narrow along the first transverse direction X2 so that they can fit in a thin slab mould, and flare out along the second transverse direction X3 to maintain a sufficient cross-sectional area (along any plane Π3 normal to the longitudinal axis X1).

With such differing bore geometries between the upstream bore portion and the front ports, it is clear that the geometry of the connecting bore portion, defined as the section of the bore system corresponding to the connecting portion of the thin slab nozzle and comprising the converging bore portion (50*e*), the thin bore portion (500, as well as the upstream portion of the front ports (51), is most critical to ensure that molten metal flows smoothly in a state so called "fully turbulent established regime" (not disturbed by large scale eddies) alike laminar for what concerns the streamlines from the upstream orifice (50*u*) of the thin slab nozzle to the downstream port orifices (51*d*).

In a section of the thin slab nozzle according to the present invention along the first symmetry plane Π1, the geometry of the wall of the central bore (50) at the connecting bore portion (50*e*) is characterized as follows:

the radius of curvature at any point of the bore wall of the converging bore portion (50*e*) is finite, and the ratio of the height Hf of the thin bore portion (500 to the height He of the converging portion (50*e*) is not more than 1, Hf/He≤1.

Figure 4A:
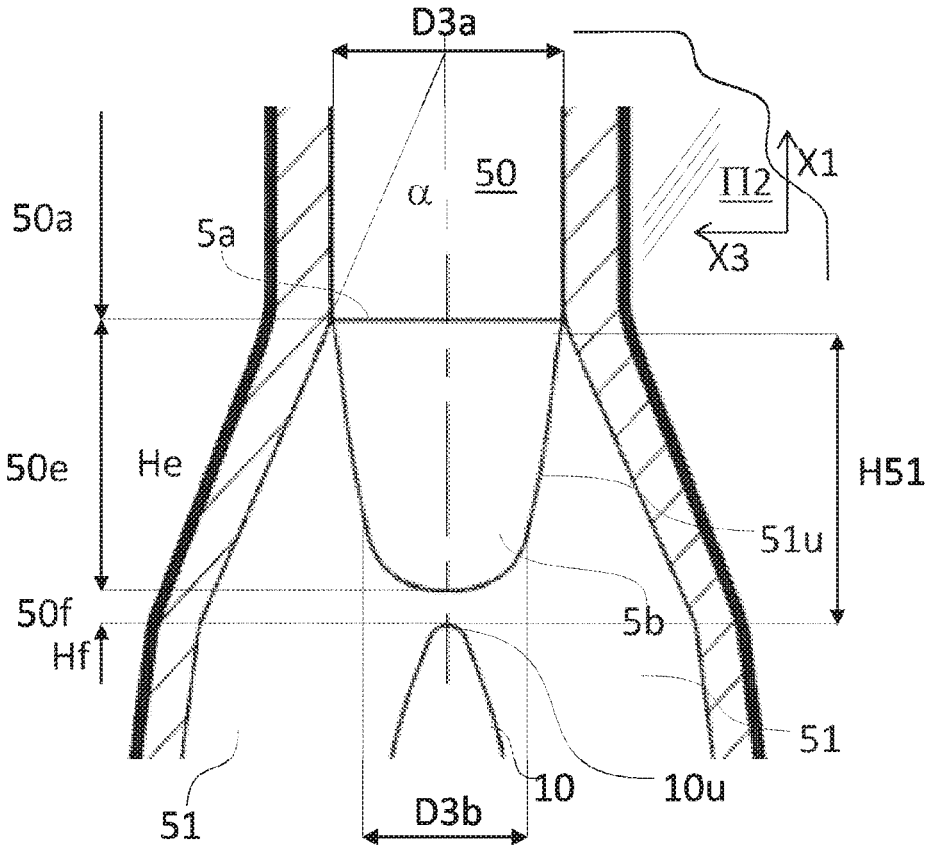
FIG. 4: shows a magnification of a portion of the section views over planes Π1, Π2, including the converging bore portion of the thin slab nozzle represented in FIG. 3.
Figure 4B:
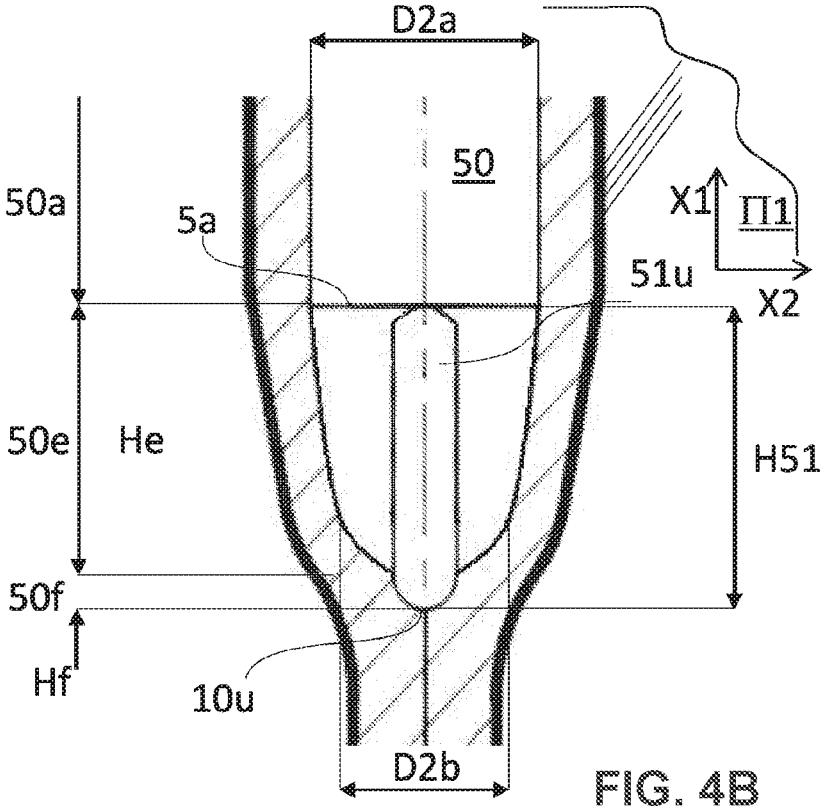

FIGS. 3 and 4 show a first embodiment of the present invention. FIGS. 3(*b*) and 4(*b*) show a section along the first symmetry plane ill defined by axis (X1, X2). By comparing views (a) and (b) of FIGS. 3 and 4, it can be seen very clearly that in the present embodiment, the upstream bore portion (50*a*) is cylindrical with straight walls, whilst the walls of the converging bore portion (50*e*) are curved. It is also important that the central bore (50) does not penetrate too far in the outlet diffusing portion of the thin slab nozzle. Namely, the height Hf of the thin bore portion (50*f*) cannot be greater than the height He of the converging bore portion (50*e*), Hf/He≤1. Efficaciously, Hf/He≤0.5 or ≤0.25, or ≤0.15. This is important to ensure that the flow of the molten metal in the front ports is sufficiently long to streamline it in the right direction before it reaches the front port outlets (51*d*). The thin bore portion (50*f*) efficaciously has a height Hf which is not more than 15%, or not more than 10%, or not more than 7%, or not more than 3% of the total height (Ha+He+Hf) of the central bore (50). In a particular embodiment, Hf=0.

Furthermore, it is advantageous that the height Hd of the portion of the bore system downstream of the central bore (50), i.e. located downstream of the upstream end (10*u*) of the divider (10) and corresponding to the height Hd of said divider, be sufficiently large for the streamlining of the flow within the first and second front ports (51). In particular, the height Hd of the divider (10) is efficaciously at least twice as large as the height He of the converging bore portion (50*e*), Hd≥2 He. Best streamlining of the flow along the first and second front ports (51) is obtained with a divider (10) characterized by two walls in a section along the second symmetry plane Π2 which extend from the upstream end (10*u*) of the divider to the downstream end of the thin slab nozzle along the longitudinal axis X1, first diverging until the divider reaches its maximum width and then converging until they reach the downstream end of the thin slab nozzle.

Figure 6A:
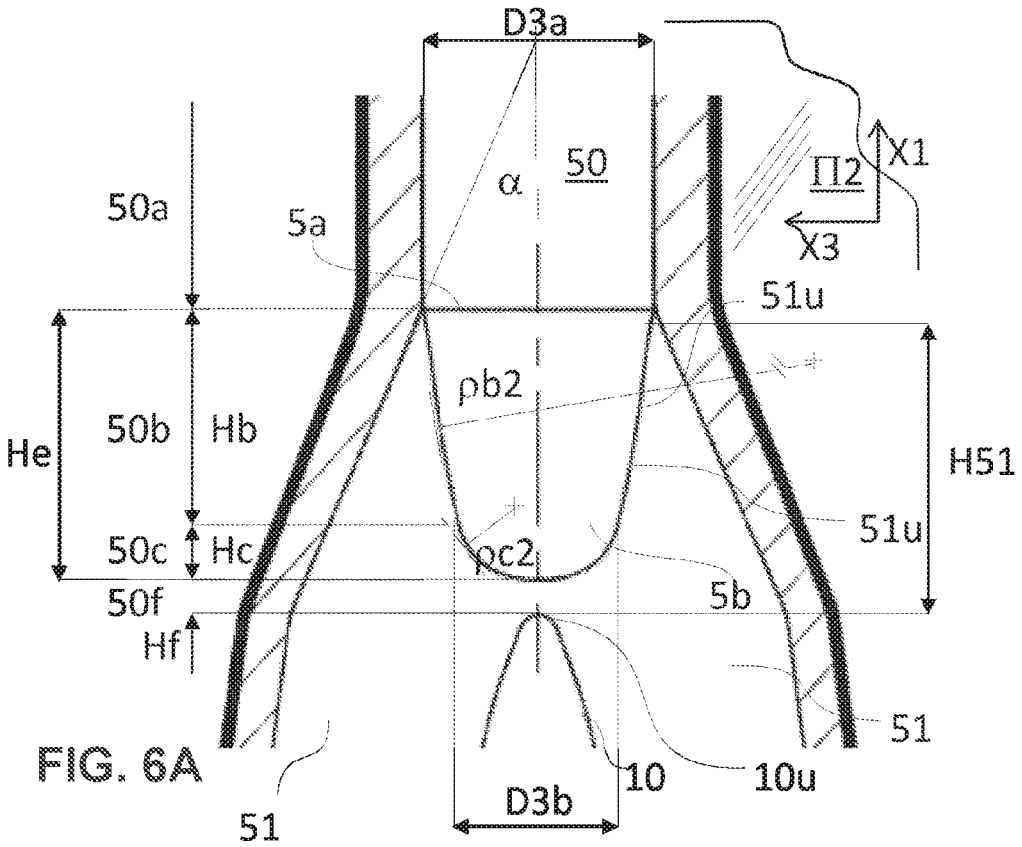
FIG. 6: shows a magnification of a portion of the section views over planes Π1, Π2, including the converging bore portion of the thin slab nozzle represented in FIG. 5.
Figure 6B:
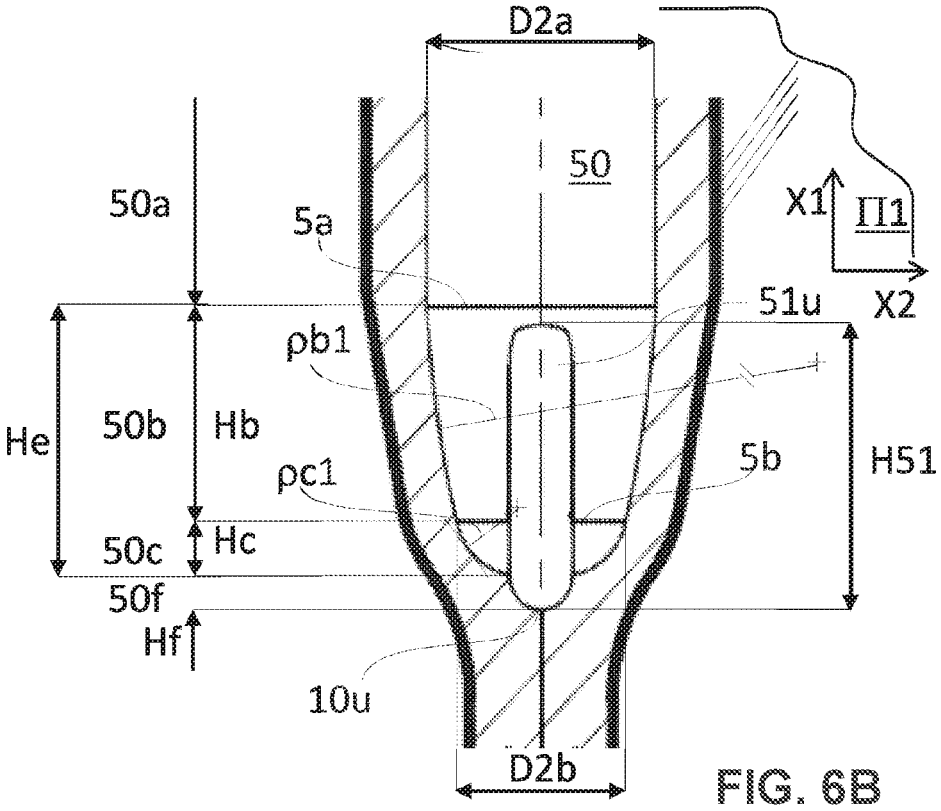

FIGS. 5 and 6 illustrate a particular embodiment of the present invention. wherein the converging bore portion (50*e*) is further divided into two bore portions:

an end bore portion (50*c*) of height Hc and a transition bore portion (50*b*) of height Hb comprised between and adjacent to the upstream bore portion (50*a*) and the end bore portion (50*c*), thus forming at one end a transition boundary (5*b*) with the end bore portion and, at the other end the upstream boundary (5*a*) with the upstream bore portion, and wherein in a section of the thin slab nozzle along the first symmetry plane ill the geometry of the wall of the converging bore portion (50*e*) is characterized as follows:

the radius of curvature ρc1 at any point of the bore wall of the end bore portion (50*c*) is not greater than ½ D2*a*, wherein D2*a* is the width of the central bore (50) at the upstream boundary (5*a*), ρc1≤½ D2*a;* the radius of curvature ρb1 at any point of the bore wall of the transition bore portion (50*b*) is greater than ½ D2*a* and equal to or greater than 5×ρc1 and equal to or less than 50×D2*a*.

In this embodiment, the height Hb of the transition bore portion (50*b*) should be substantially greater than the height Hc of the end bore portion (50*c*). In particular, the height ratio Hb/Hc should be equal to or greater than 3 and equal to or less than 12.

In a particular embodiment, the radius of curvature ρb1, ρc1 of at least one or both the transition bore portion (50*b*) and the end bore portion (50*c*) is constant over the whole height Hb, Hc of the corresponding bore portion (50*b*, 50*c*), thus defining a corresponding arc of a circle, as illustrated in FIG. 6(*b*).

It is efficacious that, excluding the presence of the first and second port inlets (51*u*), the geometry of the central bore (50) defined above with respect to a section along the symmetry plane Π1 defined by axis (X1, X2) applies mutatis mutandis to a section along the symmetry plane Π2 defined by axis (X1, X3) (as illustrated in FIG. 6(*a*) where the radii of curvature in plane Π2 are referenced by ρb2 and ρc2) and also efficaciously to a section along any plane Πi including the longitudinal axis X1. For example, the converging bore portion (50*e*) of the central bore (50), excluding the first and second port inlets (51*u*), may have an elliptical or circular cross-section along a plane Π3 normal to the longitudinal axis X1, having principal diameters D2(X1), D3(X1), along the first transverse axis X2, and second transverse axis X3, respectively, whose dimensions evolve along the longitudinal axis X1, such that the ratio D2(X1)/D3(X1) remains constant, with D2(X1)≤D3(X1). If D2(X1)=D3(X1) the cross-section of the converging portion (50*e*) is circular. If the upstream bore portion (50*a*) is cylindrical, the geometry of the central bore (50) (excluding the port inlets (51*u*)) is a geometry of revolution.

The connecting bore portion, comprising the converging and thin bore portions (50*e*, 500 must allow a smooth flow transition from a cylindrical (or similar) bore of width D2*a* at the upstream boundary (5*a*) to front ports of width W51, substantially smaller than the width D2*a*. For example, measured along the first transverse axis X2, the ratio W51/D2*a* of the width W51 of the first and second front ports along the first transverse axis X2 and the width D2*a* along the first transverse axis X2 of the central bore (50) at the upstream boundary (5*a*) is typically equal to or greater than 15% and equal to or less than 40%, or equal to or greater than 24% and equal to or less than 32%. In case of a nozzle as illustrated in FIGS. 5 and 6 wherein the converging bore portion (50*e*) comprises a transition bore portion (50*b*) and an end bore portion (50*c*), it is efficacious that the ratio D2*b*/D2*a*, of the width D2*b* along the first transverse axis X2 of the central bore (50) at the transition boundary (5*b*) to the width D2*a* along the first transverse axis X2 of the central bore (50) at the upstream boundary (5*a*) is equal to or greater than 65% and equal to or less than 85%, or equal to or greater than 70% and equal to or less than 80%. As the first and second front ports (51) are connected to the central bore (50) at the level of the converging bore portion, such geometry allows the total bore area (which is discussed more in detail below) to remain relatively constant along the longitudinal axis X1 in the transition bore portion (50*b*) and then to decrease rapidly in the end bore portion (50*c*) to build up a homogeneous pressure field prior to diverting the flow from the central bore (50*a*) towards the front ports (51).

Since the pressure in the molten metal along the longitudinal axis X1 is proportional to the cross-sectional area of the bore system, it is important that the total cross-sectional area of the bore system remains substantially constant within the central bore (50) until close to its end (10*u*), wherein the metal melt flow must be diverted towards the first and second front ports (51). This is straightforward in the upstream bore portion, since it is prismatic or slightly conical, but it is most problematic to maintain the cross-sectional area substantially constant as far down as possible the converging bore portion (50*e*). By "substantially constant" and "as far down as possible", it is meant herein that the relative variation, ΔA(X1)/Aa=|Aa−A (X1)|/Aa, of the total cross-sectional area A(X1) with respect to the total cross-sectional area Aa at the upstream boundary (5*a*) should not be greater than 15%, for any plane Π3 intersecting the longitudinal axis X1 from the upstream boundary (5*a*) down to 70% of the height He of the converging bore portion (50*e*). This means that the pressure can build up in the molten metal within a very short distance, corresponding at most to about 30% of He to deflect the metal flow sideways towards the first and second front ports (51). In particular, it is advantageous that the cross-sectional area never increases until the molten metal reaches the end of the central bore portion (10*u*) (10*u* corresponding to the upstream end of the divider 10) and flows exclusively in the front ports. Indeed, an increase in cross-sectional area in the connecting portion would create flow detachment leading to turbulences and formation of large eddies. Such requirement can be expressed in terms of the derivative dA/dX1 in the converging bore portion (50*e*) of the total cross-sectional area A on any plane Π3 normal to the longitudinal axis X1 with respect to the position of said plane Π3 on the longitudinal axis X1; said derivative being advantageously never greater than 0, dA/dX1≤0.

The evolution of the total cross-sectional bore area on a plane Π3 normal to the longitudinal axis X1, which is the sum of the cross-sectional area of the central bore (50) and of the first and second front ports (51), as a function of the position along the longitudinal axis X1 depends on the location where the first and second front ports (51) are connected to the central bore (50). As discussed above, the port inlets (51*u*) of the first and second front ports must open at least partially on two opposite walls of the converging bore portion (50*e*). It is efficacious that the upstream end of the first and second port inlets (51*u*) be located quite close to the upstream boundary (5*a*). By "quite close" it is meant herein, that the upstream end of the first and second port inlets (51*u*) be separated from the upstream boundary by not more than 7% of the height Ha of the upstream bore portion (50*a*). In practice, this should not represent more than 30 mm either upstream or downstream of the upstream boundary (5*a*). The downstream end of the first and second port inlets (51*u*) depends on the height Hf of the thin bore portion, which has been discussed above. The height Hf too is efficaciously quite small, and it is efficacious that at least 80% of the height of the front port inlets (51*u*) of the first and second front ports, or at least 90%, or at least 95%, is comprised within the converging bore portion (50*e*).

On plane Π2 defined by axis (X1, X3) (see view (a) of FIGS. 3-6) the first and second front ports (51) efficaciously meet the central bore (50) at an angle α, with respect to the longitudinal axis X1, equal to or greater than 5° and equal to or less than 45°, or equal to or greater than 15° and equal to or less than 40°, or equal to or greater than 20° and equal to or less than 30°. Each of the first and second port outlets (51*d*), on the other hand, define a plane substantially normal to the longitudinal axis X1, wherein "substantially normal" means herein 90°±5°. This means that the molten metal must flow out of the thin slab nozzle in a direction substantially parallel to the longitudinal axis X1.

Figure 7:
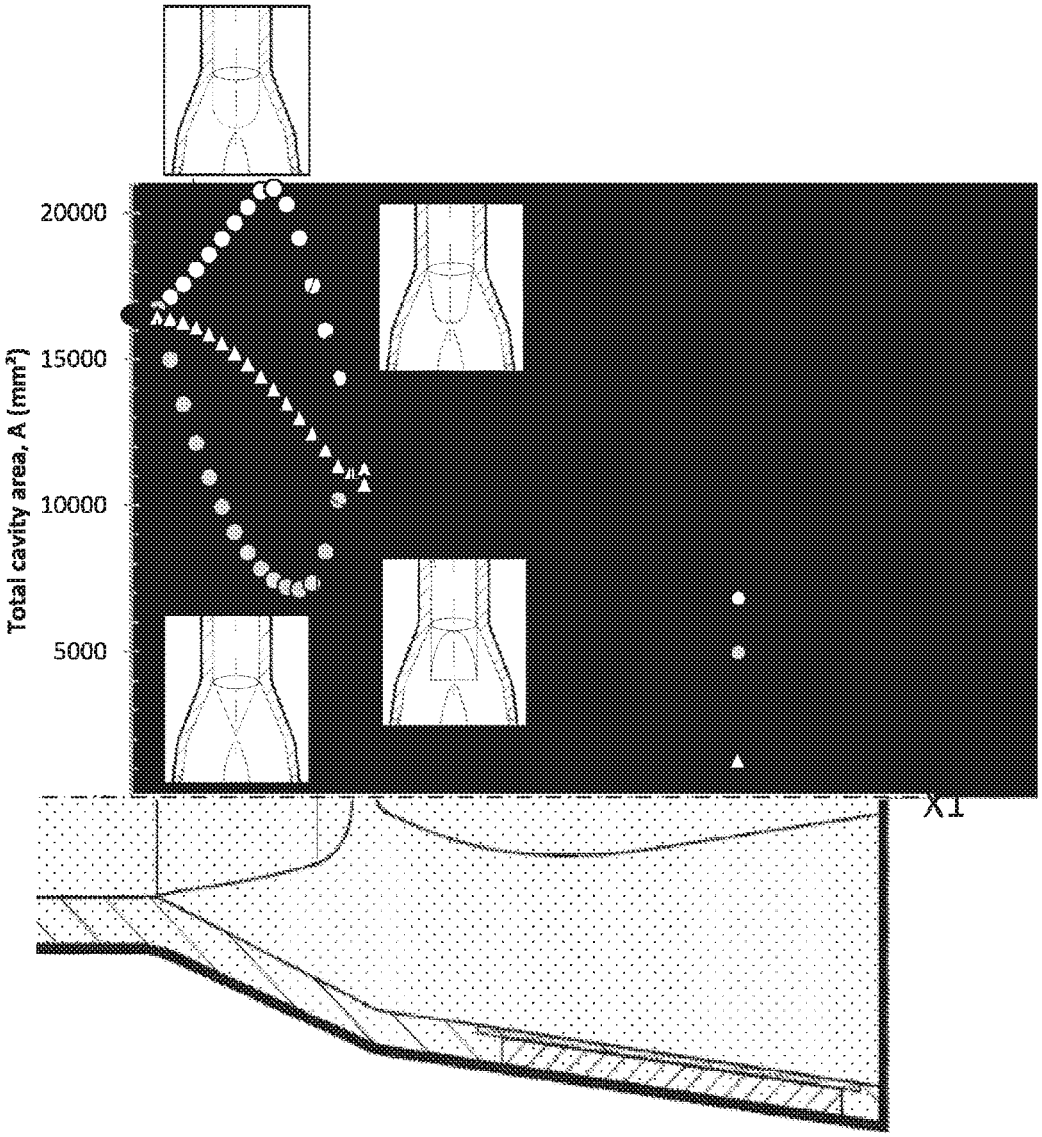
FIG. 7: is a graph that compares the cross-sectional areas of the central bore and side ports of a thin slab nozzle according to the present invention (as illustrated in FIGS. 5 and 6) with those of thin slab nozzles of the prior art.
Figure 8:
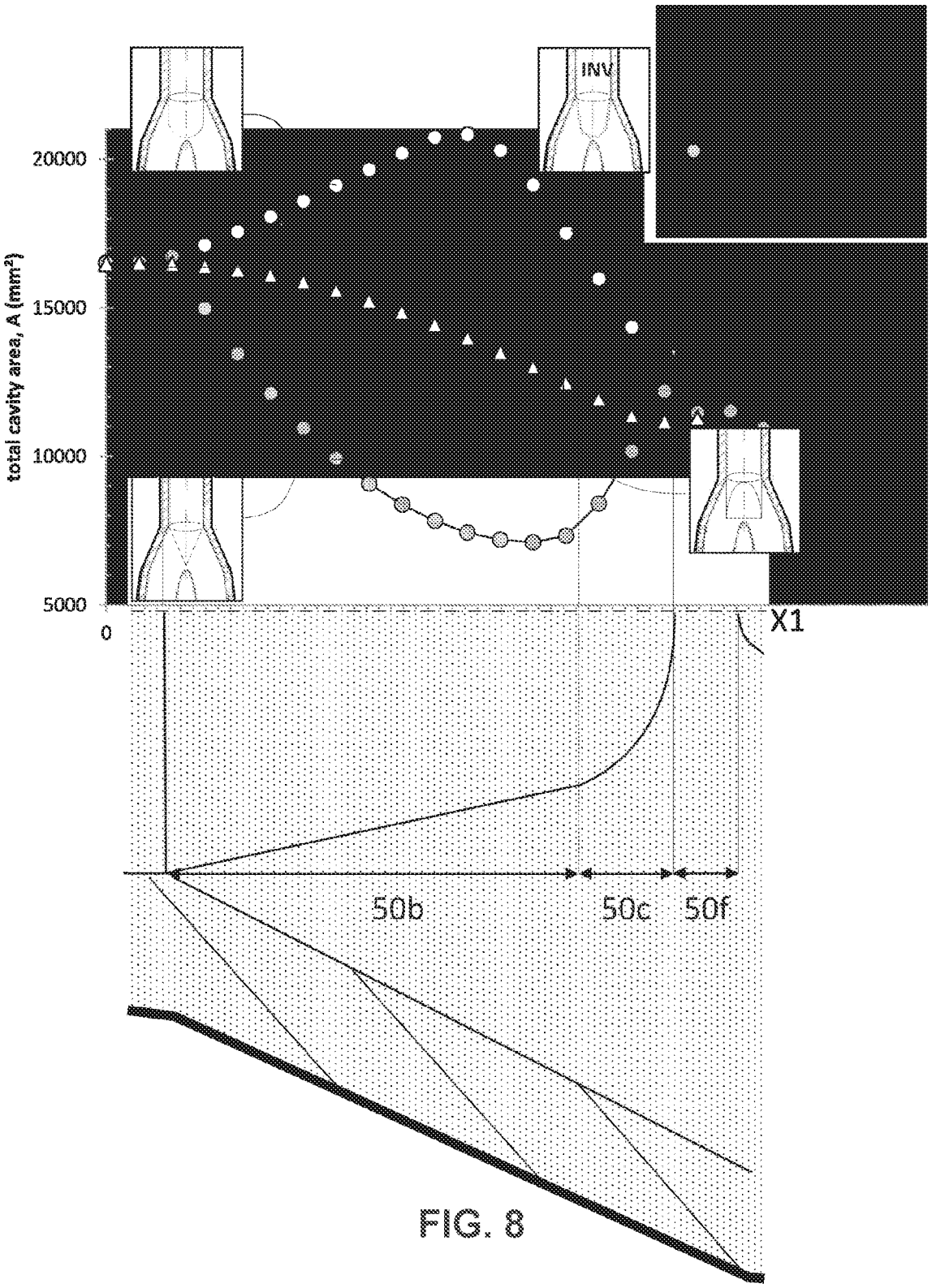
FIG. 8: shows a magnification of the graph of FIG. 7 focusing on the converging bore portion of the various thin slab nozzles.

FIGS. 7 and 8 compare the evolution of the total bore area (the area of central bore (50)+front ports (51)) as a function of the position along the longitudinal axis X1 for various thin slab nozzles differing in the geometry of the converging bore portion, wherein:

- Black circles represent a thin slab nozzle according to the present invention as illustrated in FIGS. 5 and 6;
- White circles represent a converging bore portion having a hemispherical geometry;
- Grey circles represent a converging bore portion having a conical geometry; and
- White triangles represent a converging bore portion having a "flat screwdriver" geometry, with two converging flat walls meeting at the end of the converging portion.

It can be seen in FIG. 7 how the bore cross-sectional area evolves from the upstream boundary (5*a*) down to the first and second port outlets (51*d*). Since only the geometry of the converging bore portion (50*e*) of the various nozzles plotted in FIGS. 7 and 8 was varied, the bore cross-sectional area of the bore in the outlet diffusing portion is common to all the nozzles and the curves are therefore superimposed. For the sake of clarity, only the black circles of the nozzle according to the present invention are represented in said diffusing portion. Since the width W51 measured along the first transverse axis X2 is constant over both the longitudinal axis X1 and the second transverse axis X3, the shape of the curve downstream of the central bore (50) is representative of the wall geometry of the divider (10) in a section along plane Π2. It is important to note that the height Hd of the divider (10) is greater than the height He of the converging portion, thus allowing the flow of molten metal to change direction as it passes from the central bore (50) to the first and second front ports (51) and to realign along the flow direction required by the orientation of the first and second port outlets (51*d*).

It can be seen that the cross-sectional area of the bore system varies very differently from one nozzle type to the other in the connecting bore portion. FIG. 8 is a magnification of the graph of FIG. 7, zoomed on the connecting bore portion between the upstream boundary (5*a*) down to the upstream end (10*u*) of the divider (10). It can be seen that with a hemispherical converging bore portion (white circles) the bore cross-sectional area A increases first, before dropping rapidly until the end of the central bore (10*u*). As discussed above, an increase in cross-sectional area creates flow detachment and flow recirculation generating large eddies and flow instabilities, which can result in the formation of bubbles and turbulence upon diverting the direction of the flow towards the front ports (51). Such solution is therefore not convenient for a good control of the flow through the thin slab nozzle. Inversely, the bore cross-sectional area of a conical converging bore portion (grey circles) first drops very rapidly to then increase before reaching the end of the central bore (50). Again, such sudden drop and increase in the bore cross-sectional area creates turbulence and is therefore not satisfactory. A thin slab nozzle comprising a converging portion having a "flat screwdriver" geometry (white triangles) yields an enhancement over the hemispherical and conical geometries, because the bore cross-sectional area decreases continuously without ever increasing until it reaches the end of the central bore (50). As would be expected from a geometry comprising two tapering flat walls, the bore cross-sectional area decreases substantially linearly over the whole height He of the connecting bore portion. Though an improvement over the former two geometries, by decreasing the cross-sectional area of the bore regularly over the whole height He of the converging portion, the pressure is distributed evenly and the flow from the central bore (50*a*) sideways towards the first and second front ports (51) can therefore not be driven strongly enough.

The bore cross-sectional area in a nozzle according to the present invention (black circles) decreases very slowly over more than half, or over 70% of the height He of the converging portion, and then decreases more rapidly thus creating a pressure field over a small volume at the end of the central bore (50) for re-directing (distributing) the flow of metal melt towards the first and second front ports (51) with a homogeneous pressure field. This favours the formation of a streamlined flow along the first and second front ports with substantially less risks of flow detachment and turbulence formation downstream of the central bore.

Improving the streamlining of the flow is important of course to avoid formation of turbulence, but it also allows a much more accurate control of the flow rate by the stopper. Flow rate at the inlet orifice of a thin slab nozzle is controlled by varying the distance separating the stopper head (7) and the seat of the inlet orifice (50*u*). If the evolution of the bore cross-sectional area along the longitudinal axis X1 of the nozzle creates inhomogeneity in the flow profile with local variations of the pressure fields, the accuracy of the flow rate control with the stopper becomes extremely difficult, and the flow rate is likely to fluctuate with time. As discussed in the introductory section, such flow rate fluctuations inevitably create fluctuations of the level of the meniscus in the thin slab mould with all the consequences discussed above. The present invention therefore allows a better control of the flow and flow rate of a molten metal through a thin slab nozzle than hitherto achieved. This is particularly interesting for high speed casting installation where metal, such as steel, is cast at high casting rates in the order of 5 Kg/min per mm of width (W) that means for a 1500 mm slab a rate of about 6-7 tonnes per minute. In particular, the nozzle of the invention is suitable for new installations adapted to cast thicker and wider slabs at up to 10 tonnes per minute. The nozzle according to the invention permits to cast at high speed large thin slabs having a width (W) of 1600 mm up to 2000 mm or more in thin slab continuous casting installations.

The thin slab nozzle of the present invention is particularly suitable for use in a metal casting installation for casting thin slabs comprising a tundish provided with at least an outlet in fluid communication with such thin slab nozzle. The good control of the flow of molten metal through a thin slab nozzle according to the present invention renders it ideal for use in casting installations which are coupled to a hot rolling unit for the continuous production of metal strips of thin gauge with a high degree of precision. Thin slab nozzles according to the present invention were tested by Acciaieria Arvedi SpA in a mini-mill for flat rolled products using the Arvedi Technology in Cremona (Italy) equipped with a single casting line and hot rolling unit referred to as Endless Strip Production (ESP). Strips with a gauge comprised between 0.8 mm and 12.7 mm were successfully produced continuously at constant rates with a high degree of precision. The level variations of the meniscus in the thin slab nozzle were monitored and remained very moderate, causing no problem during the production trials.

The "endless" Strip production of thin strips allows substantial savings in energy, water, and equipment costs over traditional strip production techniques. The requirements on the metal flow coming out of the thin slab nozzle and thus on the flow control out of the thin slab nozzle are however much higher than in discontinuous processes, wherein the semi-finished products can be treated somehow before being cold rolled to reduce defects. The excellent flow control obtained with a thin slab nozzle according to the present invention allows the continuous production of thin strips with homogeneous properties and is optimal for use in an ESP unit.

Numerous modifications and variations of the present invention are possible. It is, therefore, to be understood that within the scope of the following claims, the invention may be practiced otherwise than as specifically described.

What is claimed is:

1. Thin slab nozzle for casting thin slabs made of metal, said thin slab nozzle having a geometry symmetrical with respect to a first symmetry plane Π1 defined by a longitudinal axis X1 and a first transverse axis X2 normal to said longitudinal axis X1, and symmetrical with respect to a second symmetry plane Π2 defined by the longitudinal axis X1, and a second transverse axis X3 normal to both the longitudinal axis X1 and said first transverse axis X2, said thin slab nozzle extending along said longitudinal axis X1 from:

an inlet portion, located at an upstream end of the thin slab nozzle and comprising an inlet orifice oriented perpendicularly to the longitudinal axis X1 to an outlet diffusing portion located at a downstream end of the thin slab nozzle and comprising first and second outlet port orifices, said outlet diffusing portion having a nozzle width, measured along the second transverse axis X3, which is at least three times larger than a nozzle breadth of the outlet diffusing portion measured along the first transverse axis X2, and comprising a connecting portion connecting the inlet portion and the outlet diffusing portion, said thin slab nozzle further comprising:

a central bore defined by a bore wall and opening at said inlet orifice and extending therefrom along the longitudinal axis X1 until it is closed at an upstream end of a divider, said central bore comprising:

an upstream bore portion comprising the inlet orifice and extending over a height Ha and, adjacent thereto, forming an upstream boundary with a converging bore portion of height He located in the connecting portion of the thin slab nozzle, and adjacent thereto a thin bore portion of height Hf located in the diffusing portion of the thin slab nozzle and ending at the level of the upstream end of said divider, first and second front ports separated from one another by the divider and extending parallel to said second symmetry plane Π2, said first and second front ports extending from first and second port inlets opening at least partially on two opposite walls of the converging bore portion, to said first and second outlet port orifices, said first and second front ports having a width W51, measured along the first transverse axis X2, which is always smaller than a width D2(X1), of the upstream bore portion measured along the first transverse axis X2, wherein, in a section of the thin slab nozzle along the first symmetry plane Π1, a geometry of the wall of the central bore is characterized as follows:

the bore wall of the upstream bore portion is substantially straight over at least 90% of the height Ha of the upstream bore portion (excluding the region of the inlet orifice), the bore wall of the converging bore portion is curved at all points, and the ratio of the height Hf of the thin bore portion to the height He of the converging portion is not more than 1, Hf/He≤1.

2. Thin slab nozzle according to claim 1, wherein a total cross-sectional area A(X1) measured on planes Π3 normal to the longitudinal axis X1 of both the central bore and the first and second front ports is characterized in that a relative variation, ΔA(X1)/Aa=|Aa−A (X1)|/Aa, of the total cross-sectional area A(X1) with respect to the total cross-sectional area Aa at the upstream boundary is not greater than 15%, for any plane Π3 intersecting the longitudinal axis X1, from the upstream boundary down to 70% of the height He of the converging bore portion.

3. Thin slab nozzle according to claim 1, wherein the converging bore portion is further divided into two bore portions:

an end bore portion of height Hc and a transition bore portion of height Hb comprised between and adjacent to the upstream bore portion and the end bore portion, thus forming at one end a transition boundary with the end bore portion and, at the other end the upstream boundary with the upstream bore portion, and wherein in a section of the thin slab nozzle along the first symmetry plane Π1 the geometry of the wall of the converging bore portion is characterized as follows:

a radius of curvature ρc1, where measured on a section of the thin slab nozzle along the first symmetry plane Π1 at any point of the bore wall of the end bore portion is not greater than half of a width D2*a* of the central bore at the upstream boundary, ρc1≤½ D2*a;* a radius of curvature ρb1, where measured on a section of the thin slab nozzle along the first symmetry plane Π1 at any point of the bore wall of the transition bore portion is greater than half of said width D2*a* and greater than or equal to 5×ρc1 and less than or equal to 50×D2*a*; and, a height ratio, Hb/Hc, of the transition bore portion to the end bore portion is equal to or greater than 3 and less than or equal to 12.

4. Thin slab nozzle according to claim 3, wherein the geometry of the nozzle contains a feature selected from the group consisting of:

(a) the radius of curvature ρb1 is constant at any point of the bore wall of the transition bore portion and (b) the radius of curvature ρc1 is constant at any point of the bore wall of the end bore portion.

5. Thin slab nozzle according to claim 4, wherein, excluding the first and second port inlets, the radii of curvature and the height ratios of the bore wall of the converging bore portion, transition bore portion and end bore portion defined with respect to a section of the thin slab nozzle along the first symmetry plane Π1, apply also to a section of the thin slab nozzle along the second symmetry plane Π2.

6. Thin slab nozzle according to claim 1, wherein the converging bore portion of the central bore, excluding the first and second port inlets, has an elliptical or circular cross-section along a plane Π3, normal to the longitudinal axis X1, having principal diameters, D2(X1), D3(X1), along the first transverse axis X2 and second transverse axis X3 respectively, whose dimensions evolve along the longitudinal axis X1, such that a ratio D2(X1)/D3(X1) remains constant, with D2(X1)≤D3(X1).

7. Thin slab nozzle according to claim 5, wherein the converging bore portion (50*e*) has a geometry of revolution about the longitudinal axis X1, excluding the first and second port inlets (51*u*).

8. Thin slab nozzle according to claim 1, wherein a distance between the upstream end of the thin slab nozzle and the upstream end of the first and second port inlets is comprised within the height Ha of the upstream bore portion ±7% and wherein on the second symmetry plane Π2, the first and second front ports meet the central bore at an angle α, with respect to the longitudinal axis X1, equal to or greater than 5° and equal to or less than 45°.

9. Thin slab nozzle according to claim 1, wherein the geometry in a section along the second symmetry plane Π2, of the walls of the divider in contact with the first and second front ports is characterized by both walls extending from the upstream end of the divider to the downstream end of the thin slab nozzle along the longitudinal axis X1, by first diverging until the divider reaches its maximum width and then converging until they reach the downstream end of the thin slab nozzle.

10. Thin slab nozzle according to claim 1, wherein a height Hd of the divider is at least twice as much as the height He of the converging bore portion, Hd≥He.

11. Thin slab nozzle according to claim 1, wherein a ratio W51/D2*a*, of the width W51 of the first and second front ports along the first transverse axis X2, to the width D2*a* along the first transverse axis X2 of the central bore at the upstream boundary is equal to or greater than 15% and equal to or less than 40%.

12. Thin slab nozzle according to claim 3, wherein a ratio D2*b*/D2*a*, of a width D2*b*, along the first transverse axis X2, of the central bore at the transition boundary to the width D2*a*, along the first transverse axis X2 of the central bore at the upstream boundary is equal to or greater than 65% and equal to or less than 85%.

13. Thin slab nozzle according to claim 1, wherein a derivative dA/dX1 in the converging bore portion of a total cross-sectional area A on any plane n3 normal to the longitudinal axis X1 with respect to a position of said plane n3 on the longitudinal axis X1 is never greater than 0, dA/dX1≤0.

14. Thin slab nozzle according to claim 1, wherein, the ratio of the height Hf of the thin bore portion to the height He of the converging bore portion is not more than 50%, and the ratio of the height Hf of the thin bore portion to the total height of the central bore is not more than 15%.

* * * * *